US005701823A

United States Patent [19]

Morris

[11] Patent Number: 5,701,823

[45] Date of Patent: Dec. 30, 1997

[54] SELF ALIGNING TOOL FOR REGISTERING ROTARY PRINTING PLATES AND METHOD OF REGISTERING PLATES

[76] Inventor: Jerry L. Morris, 304 S. Philpot St., Cedartown, Ga. 30125

[21] Appl. No.: 791,463

[22] Filed: Jan. 27, 1997

[51] Int. Cl.[6] ..... B41L 3/02

[52] U.S. Cl. ..... 101/486; 101/415.1; 101/DIG. 36; 33/618

[58] Field of Search ..... 101/486, DIG. 36, 101/415.1, 216, 177, 174, 248; 33/614, 616, 617, 618, 621

[56] References Cited

U.S. PATENT DOCUMENTS

| | | | |
|---|---|---|---|
| 2,559,533 | 7/1951 | Daniels | 33/618 |
| 2,907,274 | 10/1959 | Taylor | 101/DIG. 36 |
| 3,281,946 | 11/1966 | Walsh | 33/618 |
| 4,033,259 | 7/1977 | Schuhmann | 101/174 |
| 4,309,804 | 1/1982 | Sarka | 101/DIG. 36 |
| 4,446,625 | 5/1984 | Hagen et al. | 33/184.5 |
| 4,508,802 | 4/1985 | Heiart et al. | 430/22 |
| 4,518,667 | 5/1985 | Heiart | 430/22 |
| 4,569,286 | 2/1986 | Bleckmann | 101/382 R |
| 4,604,811 | 8/1986 | Roosen | 101/DIG. 36 |
| 4,622,895 | 11/1986 | Dorow et al. | 101/153 |
| 4,809,607 | 3/1989 | Dorow et al. | 101/415.1 |
| 4,846,063 | 7/1989 | Brown | 101/415.1 |
| 5,003,878 | 4/1991 | Dorow et al. | 101/415.1 |
| 5,317,971 | 6/1994 | Deye, Jr. et al. | 101/486 |
| 5,439,328 | 8/1995 | Haggerty et al. | 408/1 R |

*Primary Examiner*—Christopher A. Bennett
*Attorney, Agent, or Firm*—Harris Zimmerman

[57] ABSTRACT

A registering tool and registering method enables adhering of flexographic printing plates to the cylindrical surface of a rotary press plate cylinder in a manner which assures that the upper and lower edges of the plate are aligned in a strictly parallel relationship with the axis of rotation of the plate cylinder. The tool includes a channel shaped elongated bar having side walls with lower edges which are rested on the cylindrical surface of the cylinder in parallel relationship with the axis of the cylinder. A row of register pin receiving openings extends along a side wall of the bar in parallel relationship with the lower edge of the side wall. The printing plate is temporarily pinned to the bar with register pins which are inserted into registration holes in the printing plate that are equidistant from the upper edge of the plate. A first portion of the plate is then adhered to the cylinder. The plate is then unpinned and the bar is removed enabling the remainder of the plate to be wrapped around the cylinder and adhered thereto.

14 Claims, 5 Drawing Sheets

SELF ALIGNING TOOL FOR REGISTERING ROTARY PRINTING PLATES AND METHOD OF REGISTERING PLATES

TECHNICAL FIELD

This invention relates to flexographic printing and more particularly to tools and procedures for enabling precise and repeatable positioning of flexible printing plates on the plate cylinders of rotary printing presses.

BACKGROUND OF THE INVENTION

Rotary printing presses use flexible printing plates which are secured to the cylindrical surface of a plate cylinder that revolves in the course of a printing operation. Quality printing requires that the printing plates be precisely positioned at the cylinder surface. This includes aligning horizontal edges of the printing plate in an exactly parallel relationship with the axis of rotation of the plate cylinder to avoid skewing of the printing plate relative to the cylinder surface. Precise registering of the printing plates is particularly important during color printing in which different colors are imprinted on the same substrate by more than one printing plate. Different colors that are out of register with each other greatly detract from the appearance of the printed product.

A variety of off press plate mounting and proofing devices are used to effect accurate registration of printing plates. Prior apparatus for this purpose is undesirably complicated and costly and may not always assure precise registration.

In a pin register bar type of mounting device, for example, the plate is temporarily pinned to a register bar at two or more holes which are located along a horizontal line in the plate. The pin register bar is then set on the journals which extend from opposite ends of the plate cylinder to establish a parallel alignment of the bar with the cylinder surface. A portion of the plate is then adhered to the cylinder surface after which the bar is removed and the remainder of the plate is wrapped around and adhered to the cylinder. Bent or dirty cylinder journals can cause mis-alignment of printing plates when apparatus of this kind is used.

Another device of this kind has a swing arm to which the plate is temporarily pinned and which is pivoted to the frame of mounter proofer apparatus. The arm is pivoted to bring the plate into an aligned relationship with the plate cylinder prior to adhering of the plate to the cylinder. The mechanism is somewhat complicated and costly and can only be used with the even more costly mounter proofer.

Video mounters operate with printing plates which have register marks positioned to enable alignment of the plate with the plate cylinder. A video camera on each side of the mounter magnifies the register mark images and displays them on a split screen monitor. The operator can align the plate with the plate cylinder while viewing the magnified images. Video monitors are very costly. An experienced operator requires about fifteen minutes per color to prepare for a color printing operation.

Thus there is a need for a low cost plate registering device and procedure that does not necessarily require costly additional equipment, which requires a minimum of training and skill on the part of the operator and which reliably aligns edges of a printing plate in an exactly parallel relationship with the axis of a print cylinder.

The present invention is directed to overcoming one or more of the problems discussed above.

SUMMARY OF THE INVENTION

In one aspect of the present invention, apparatus for registering flexographic printing plates with a rotary printing press plate cylinder includes an elongated bar having a row of register pin receiving openings extending along an outward facing surface of the bar which row includes at least two of the openings. The bar has first and second plate cylinder contacting regions which are linear and parallel to the row of register receiving openings, the plate cylinder contacting regions being spaced apart and being separated by an open region.

In another aspect of the invention, the row of register pin receiving openings includes a first plurality of register pin openings spaced apart along a first end region of said bar and a second plurality of register pin openings spaced apart along an opposite second end region of said bar. A first dimension scale extends along the bar adjacent the first plurality of register pin openings and a second dimension scale extends along the second plurality of register pin openings. The numerical sequence of the second dimension scale is the reverse of the numerical sequence of the first dimension scale.

In another aspect, the invention provides a tool for registering flexographic printing plates with a rotary printing press plate cylinder comprising an elongated bar of substantially channel shaped configuration which includes a pair of side wall portions with inner edges joined by a central wall portion. At least a first of the side wall portions forms an obtuse angle with the central wall portion. The side wall portions have spaced apart parallel linear outer edges for abutment against a top region of a printing press cylinder while the bar extends in parallel relationship therewith. The first side wall portion of the bar has a row of spaced apart register pin receiving openings extending therealong which openings are equidistantly spaced from the plane defined by the parallel linear outer edges of the side wall portions of the bar.

In still another aspect the invention provides a method of mounting flexographic printing plates on the cylindrical surface of a rotary printing press plate cylinder. The method includes the step of resting a substantially channel shaped bar on the cylindrical surface in an orientation at which parallel spaced apart linear edges of the channel shaped bar are in abutment with the cylindrical surface. A flexographic printing plate, having spaced apart register pin openings, is pinned to the bar at locations thereon which are equidistant from the cylindrical surface. A first portion of the flexographic printing plate is then adhered to the cylindrical surface of the plate cylinder. The printing plate is then unpinned from the bar and the bar is removed from the cylindrical surface. The printing plate is then wrapped around the cylindrical surface and other portions of the plate are adhered thereto.

The invention differs from prior apparatus for registering flexographic printing plates at a plate cylinder in that it is designed to be disposed against the cylindrical surface of the plate cylinder rather than being supported by adjacent mounter proofer framework or being contacted against the cylinder journals. A bar having the shape of an inverted channel member inherently aligns itself with the axis of a cylinder when it is rested on the cylindrical surface of the cylinder. The self alignment effect is very precise and is automatically reproduced during mounting of a series of printing plates. Specialized additional equipment is not necessarily required in order to mount printing plates. The self aligning plate mounting tool may be used while the plate cylinder is supported by a simple cylinder rack or simply resting on a table or even while the cylinder is in the printing press. The operator needs only a minimum of training and need not have specialized skills.

The invention, together with further aspects and advantages thereof, may be further understood by reference to the following description of the preferred embodiment and by reference to the accompanying drawings.

DETAILED DESCRIPTION OF THE PREFERRED EMBODIMENT

Figure 1:
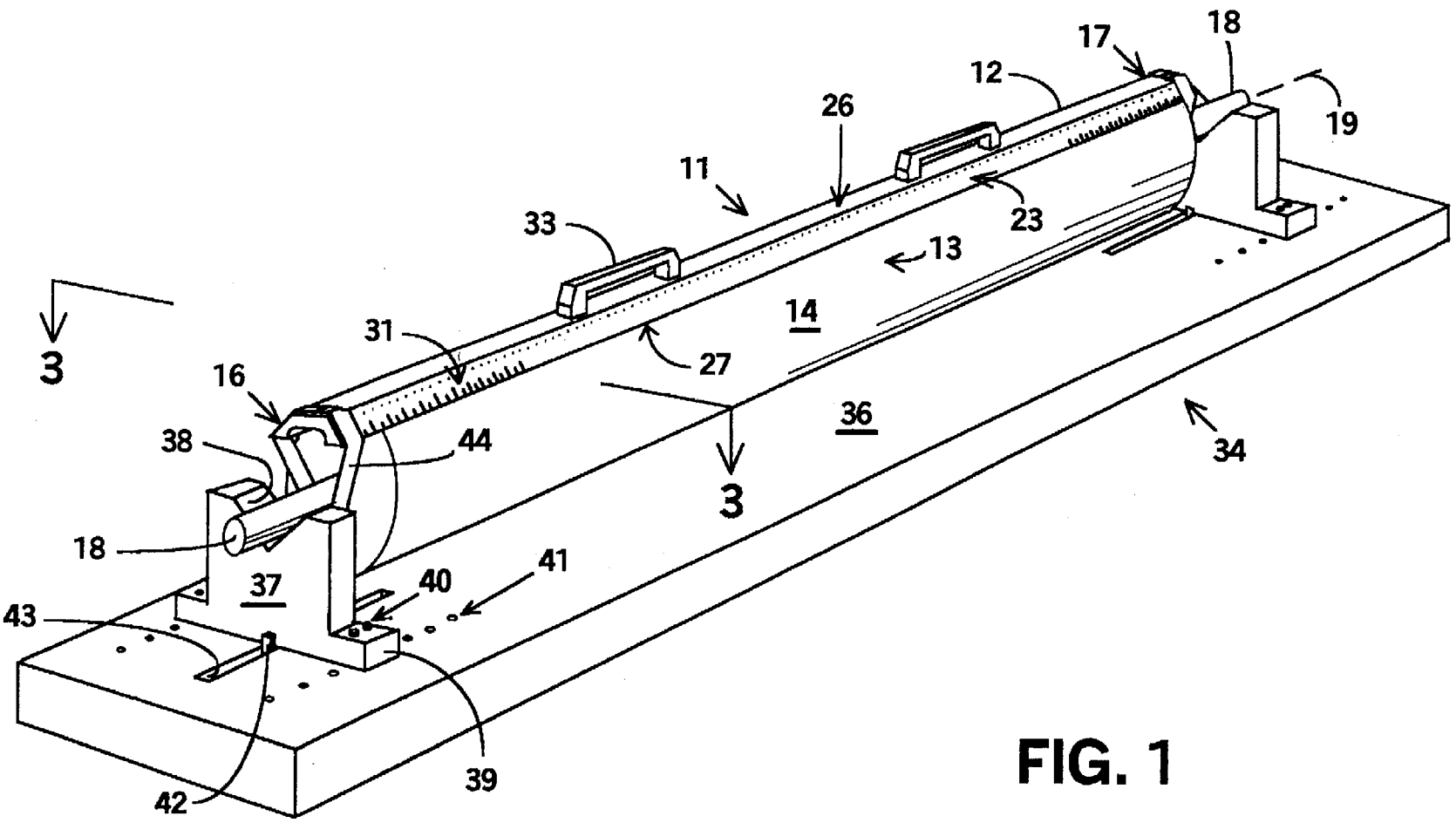
FIG. 1 is a perspective view of a printing plate registration tool embodying the invention shown together with a printing press plate cylinder and a cylinder support.

Referring initially to FIG. 1 of the drawings, a printing press registration tool 11 in accordance with this embodiment of the invention includes an elongated linear bar 12 which in use is disposed against the cylindrical surface 13 of a printing press plate cylinder 14 of the known form. The bar 12 is preferably longer than the body of the plate cylinder 14 so that first and second end portions 16 and 17 respectively of the bar extend outward from the cylinder body at both ends of the cylinder body in parallel relationship with the journals 18 of the plate cylinder.

Figure 2:
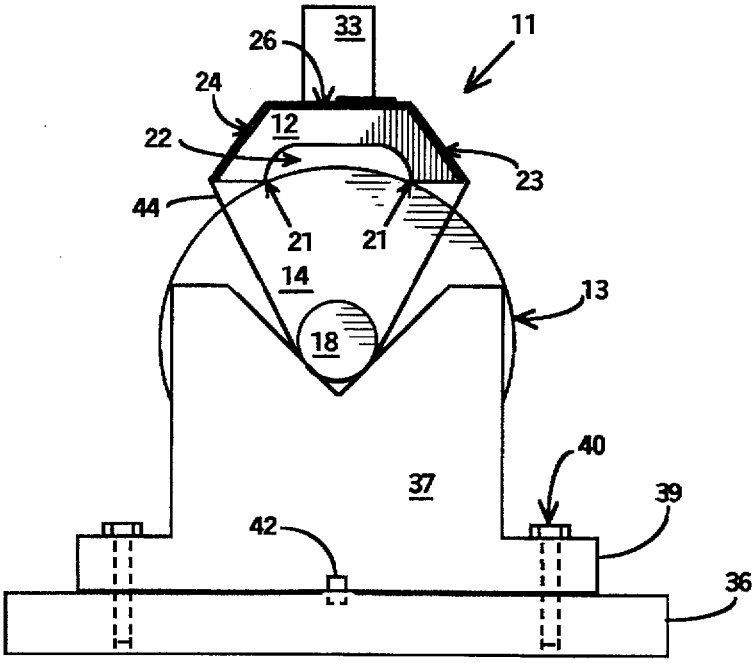
FIG. 2 is an end view of the apparatus of FIG. 1.

Referring jointly to FIGS. 1 and 2, the bar 12 has a configuration which causes it to position itself in a precisely parallel relationship with the axis of rotation 19 of the plate cylinder 14. In particular, the bar 12 is shaped to bear against the plate cylinder 14 along two linear zones of contact which are parallel with each other with the region 22 which extends between the two zones being an open space. In the present example the bar 12 has a generally channel member shape. First and second side wall portions 23 and 24 of the bar 12 extend from a central portion 26 and have lower edges 27 which bear against the plate cylinder 14 to define the two parallel linear contact zones. In other embodiments, the bar 12 can have other cross sectional profiles provided that contact with an underlying cylindrical surface occurs along two parallel linear zones that are separated by open space.

The lower edges 27 which bear against the cylinder 14 are continuous along the length of bar 12 in this example which is advantageous in that it adapts the tool 11 for use with cylinders 14 of differing lengths. The tool 11 remains operable if the edges 27 are discontinuous provided that they are present at least at two spaced apart regions along the length of the bar 12.

Figure 3:
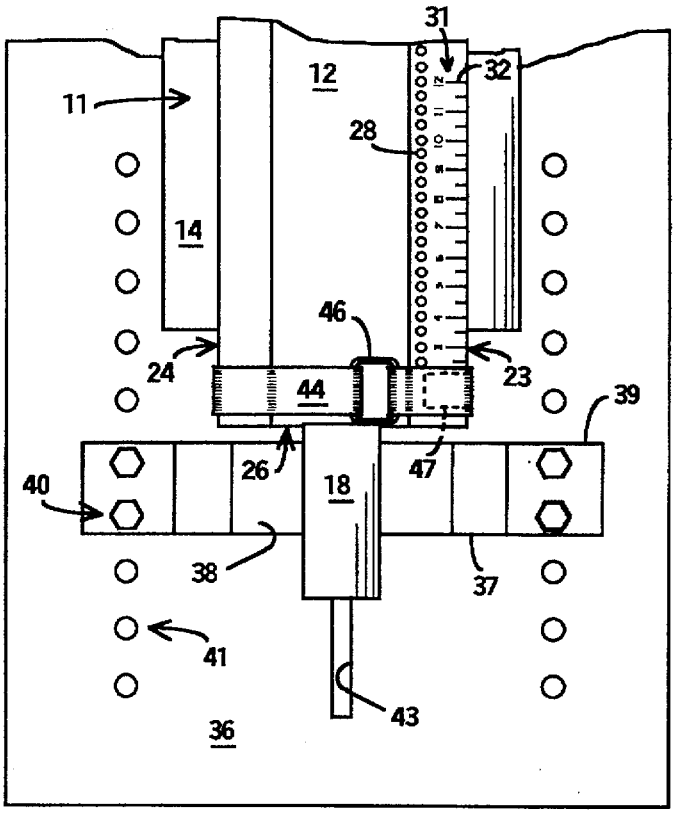
FIG. 3 is a top view of an end portion of the apparatus of the preceding figures taken along line 3—3 of FIG. 1.
Figure 4:
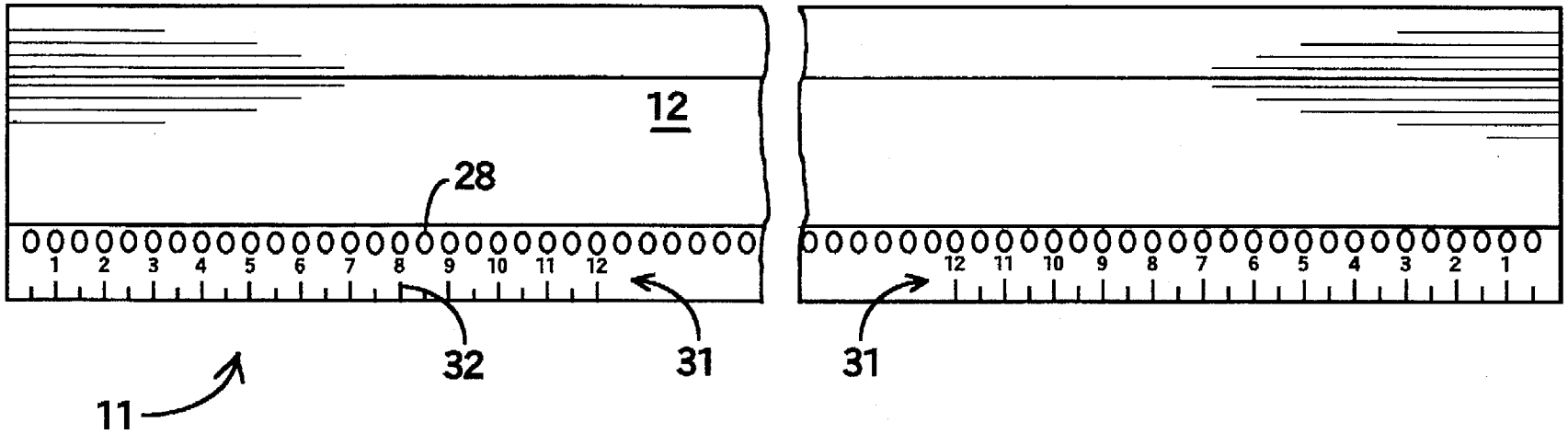
FIG. 4 is a foreshortened top view of the tool of the preceding figures.
Figure 5:
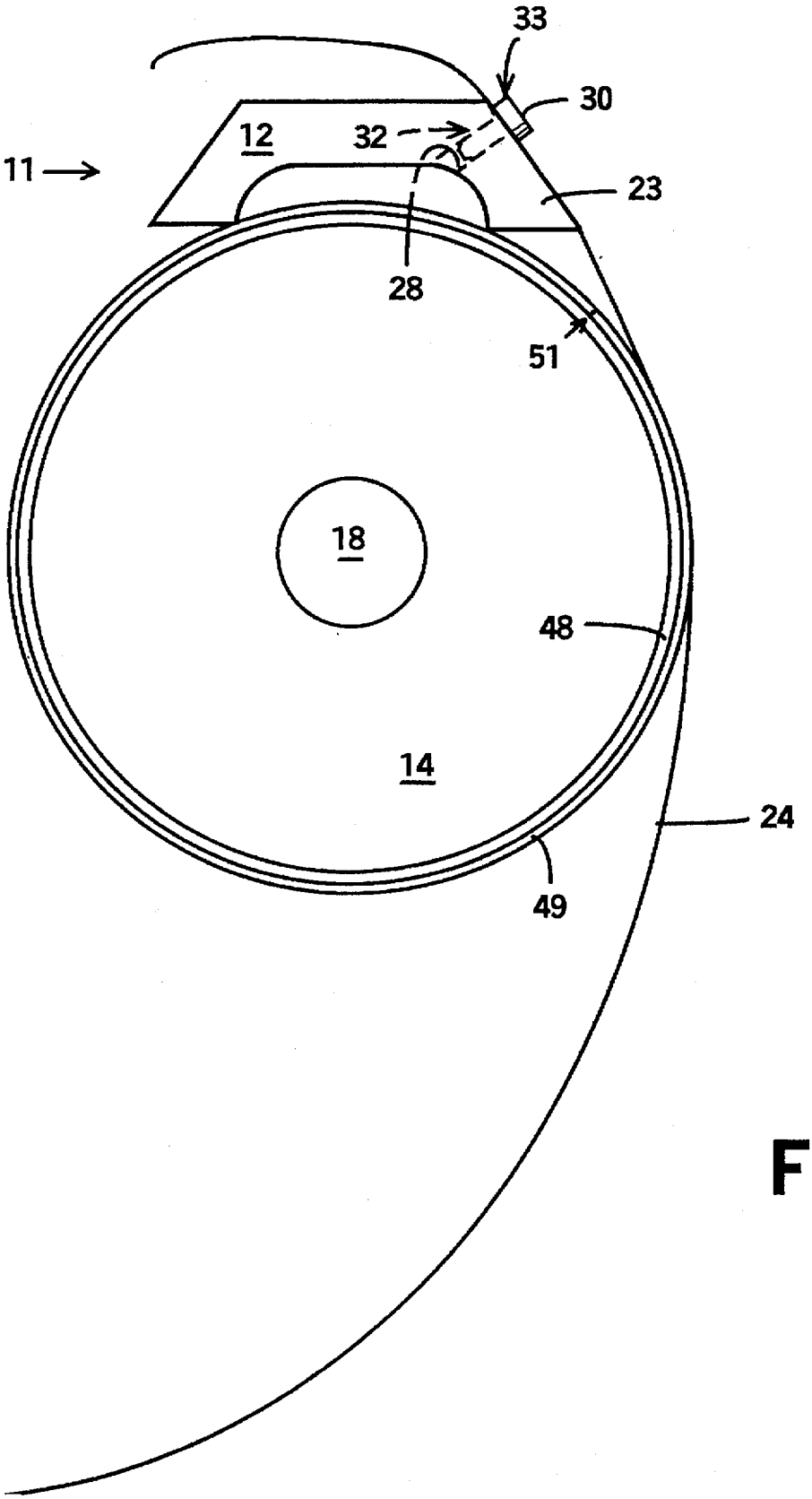
FIG. 5 is a diagrammatic end view of the tool and a print cylinder illustrating usage of the device.
Figure 6:
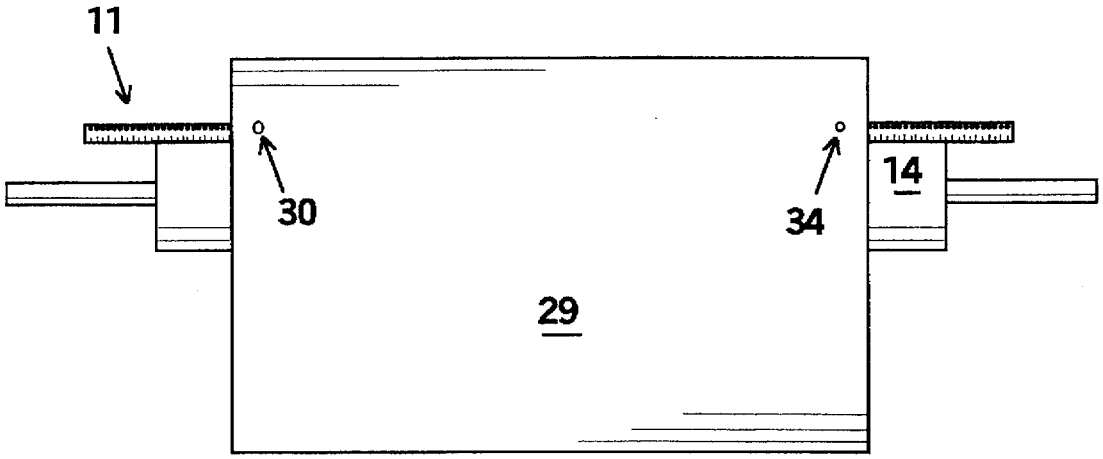
FIG. 6 is a frontal diagrammatic elevation view of the tool and a print cylinder further illustrating usage of the device.

Referring jointly to FIGS. 3 and 4, a row of internally threaded register pin receiving openings 28 extends along the first side wall portion 23 of bar 12, the row being parallel to the outer edge 27 of the side wall portion. Referring to FIGS. 5 and 6 in conjunction with FIG. 3, the openings 28 enable temporary pinning of a flexible printing plate 29 to the bar 12 by register pins 30 which have threaded shafts 32 and a knob enlargement 33 at one end to facilitate turning of the pin. Printing plates 29 are provided with two or more spaced apart register holes 34 which are punched or drilled and which are situated along a line that extends at right angles to the edges of the plate. The plate 29 is pinned to bar 12 by inserting the register pins 30 through holes 34 and then engaging the pins in the threaded openings 28 of the bar.

The tool 11 of this example has a continuous row of the pin receiving openings 28 which extends from one end of the bar 12 to the other end, the openings having centers which are spaced one half inch apart in this particular example of the invention. This enables use of the tool 11 with printing plates 29 that have different widths. In other embodiments of the invention the pin receiving openings 28 may be present only on the end regions of the bar 11 or, if the tool is intended to be used with only a single size of printing plate, there may be only two of the pin receiving openings on the bar.

Dimension scales 31 extend along the outer face of the first side wall portion 23 of bar 12 at each end portion of the bar to facilitate centering of the tool 11 and printing plates 29 between the ends of the plate cylinder 14. The scales 31 are adjacent to the pin receiving openings 28 and have spaced apart parallel linear markings 32 each of which is directed towards a separate one of the pin receiving openings. Successive markings 32 of this particular example are one half inch apart to correspond with the spacing of pin receiving openings 28 and alternate ones of the markings are identified by a numeral marking which identifies the distance of the marking from the nearest end of bar 14 in inches. As may be seen in FIG. 4, the numerical sequence of the numeral markings at the right end portion of bar 12 is reversed relative to the sequence of the numeral markings at the left end portion so that corresponding numerals at each end portion of the bar are at the same distance from the closest end of the bar.

Referring again to FIG. 1, the scales 31 allow the operator to quickly ascertain that the side edges of a printing plate 29 are equidistant from the ends of cylinder 14 prior to pinning of the plate to the bar in the previously described manner. The scales 31 similarly allow the operator to quickly center the tool 11 itself relative to the cylinder 14 by making it apparent when opposite ends of bar 12 extend outward from the cylinder surface 13 for equal distances.

The pin receiving openings 28 and the markings and numerals of scales 31 may be fixed in accordance with other dimensional unit systems such as metric units for example.

A pair of handles 33 are secured to the bar 12 at spaced apart locations therealong to facilitate lifting and maneuvering of the bar. The handles 33 of this example are secured to the central portion 26 of the bar 12 and extend directly upward therefrom. Alternately, the handles 33 can be secured to the second side wall portion 24 and protrude outward therefrom in an inclined direction.

It is preferable, although not essential, that the outer surface of the first side wall portion 23 of bar 12 at which pin receiving openings 28 and scales 31 are located be slanted in a manner which causes it to form an obtuse angle with the central portion 16 of the bar. This facilitates viewing of the openings 28 and scales 31 and also the previously described operation of pinning plates to the tool 11.

The tool 11 can be used to mount printing plates on a cylinder 14 which is resting on a table or similar surface or which remains in the printing press but operation is most convenient if the cylinder is temporarily supported by a cylinder rack 34. The rack 34 of this example has a base plate 36 on which two upwardly extending cylinder support blocks 37 are disposed. The blocks 37 are spaced apart by a distance slightly greater than the length of the body of the cylinder 14 thereby enabling seating of the journals 18 of the cylinder in notches 38 in the upper edges of the block which notches are of progressively diminishing width in the downward direction. The support blocks 37 are each slidable longitudinally along base plate 36 to accommodate to cylinders 14 of different lengths. For this purpose tabs 39 at the bases of the blocks 37 are fastened to the base plate 36 by disengagable screws 40 and the base plate has plural sets of threaded screw holes 41 near each end of the base plate with the sets being at progressively greater distances from the nearby end of the base plate. A key 42 protrudes downward from the bottom of each block 37 into a linear keyway 43 in the base plate that extends longitudinally thereon. This prevents turning of the blocks and prevents lateral movement the blocks as they are traveled between one set of screw holes 41 and another.

Referring to FIGS. 2 and 3, resting of the tool 11 on a cylinder 14 that is free to revolve creates a top heavy condition that may tend to turn the cylinder. To prevent dropping of the tool 11 if this should occur, the ends of bar 11 that extend out over the cylinder journals 18 may be temporarily strapped to the journals. In the present example one of a pair of fabric straps 44 is looped around each end of the bar 12 and around the underlying cylinder journal 18 and is buckled to form a continuous belt. In this example, straps 44 each have a closed loop buckle 46 at one end. The opposite end portion of the strap is passed through the buckle 46 and turned back and fastened to itself by hook and loop fabric closure material 47 of the type sold under the trademark "Velcro".

Referring jointly to FIGS. 5 and 6, it is the current practice in the art to secure printing plates 29 to plate cylinders 14 by wrapping a layer of double sided adhesive tape 48, known as stickyback tape, around the cylinder which layer covers the area of the cylindrical surface 13 of the cylinder at which the plate is to be secured to the cylinder. A cover layer 49 of non-adhesive material which initially covers the double sided adhesive tape 48 is stripped away and the printing plate 29 itself is wrapped around the cylinder and held in place by the tape. The tool 11 of the present invention is compatible with this method of securing the plate to the cylinder.

During use of the present invention, the flexible printing plate 29 is pinned to tool 11 in the previously described manner and the tool is rested on the top of the plate cylinder 14 and buckled to the cylinder journals 18 as has also been described. Prior to emplacement of the tool 11 on the cylinder 14, the cylinder is turned to place the adjoining edges 51 of the adhesive tape cover layer 49 at a location that will be just below the first side wall portion 23 of tool 11 when the tool rested on the cylinder.

The configuration of bar 11 inherently causes the bar to assume an orientation at which it is precisely parallel with the rotary axis of the cylinder 14. As the register pin openings 34 are equidistant from the top edge of the plate 29 and the register pin receiving openings 28 are now equidistant from the cylindrical surface of the plate cylinder 14, the plate is in precise register. The portion of the adhesive tape cover layer 49 which below the first side wall portion 23 of tool 11 is then peeled away to expose the adhesive back of tape layer 48 and the printing plate 29 is the pressed against the exposed adhesive to adhere the plate to cylinder 14. Register pins 30 are then disengaged and the tool 11 is removed from the cylinder 14. The remaining cover layer 49 is then stripped away from the adhesive tape layer 48 and the print plate 29 is wrapped around the cylinder while being pressed against the adhesive to complete the plate mounting process. The cylinder 14 may be rotated during the wrapping step to facilitate to facilitate the operation.

While the invention has been described with reference to a single embodiment for purposes of example, many modifications and variations are possible and it is not intended to limit the invention except as defined by the following claims.

I claim:

1. Apparatus for registering flexographic printing plates with a rotary printing press plate cylinder comprising an elongated bar having a row of register pin receiving openings extending along an outward facing surface of the bar which row includes at least two spaced apart register pin receiving openings, said bar having first and second plate cylinder contacting regions which are linear and parallel to said row of register receiving openings, said first and second plate cylinder contacting regions being spaced apart and being separated by an open region.

2. The apparatus of claim 1 wherein said row of register pin receiving openings extends along a side surface of said bar.

3. The apparatus of claim 2 wherein said side surface of said bar is slanted and extends outward and downward from a central portion of said bar.

4. The apparatus of claim 1 wherein said bar has a substantially channel shaped configuration with a pair of spaced apart side portions which are joined by a central portion at upper edges of said side portions, said plate cylinder contacting regions being lower edges of said side portions.

5. The apparatus of claim 1 wherein said plate cylinder contacting regions extend continuously along said bar.

6. The apparatus of claim 1 wherein said row of register pin receiving openings includes a first plurality of register pin openings spaced apart along a first end region of said bar and a second plurality of register pin openings spaced apart along an opposite second end region of said bar.

7. The apparatus of claim 6 wherein said first plurality of register pin opening extends along a left end region of said bar and said second plurality of register pin openings extends along a right end region of said bar, further including a first dimension scale extending along said bar adjacent to said first plurality of register pin openings and a second dimension scale extending along said bar adjacent to said second plurality of register pin openings, said first dimension scale having numerals which increase in numerical value in a left to right direction and said second dimension scale having numerals which increase in numerical value in a right to left direction.

8. The apparatus of claim 1 wherein said register pin receiving openings are internally threaded, further including at least a pair of printing plate register pins each being adapted for engagement in a separate one of said register pin receiving openings, each of said register pins having an externally threaded shaft and an enlargement at one end thereof.

9. The apparatus of claim 1 further including first and second straps forming loops and which are proportioned to be looped around opposite ends of said bar and around journals at opposite ends of a printing press plate cylinder.

10. The apparatus of claim 1 further including at least one lifting handle secured to said bar and protruding outward therefrom at a location thereon that is above said plate cylinder contacting regions when said bar is rested on the top of a plate cylinder.

11. The apparatus of claim 1 further including a printing press plate cylinder having journals extending from opposite ends thereof that define an axis of rotation thereof, said bar being rested on a top region of said printing press plate cylinder in parallel relationship with said axis of rotation.

12. The apparatus of claim 11 further including a cylinder rack having a base with upward extending blocks thereon, each block having a notch therein which is of progressively decreasing width in the downward direction, said journals of said printing press plate cylinder being rested in the notches of said block.

13. A tool for registering flexographic printing plates with a rotary printing press plate cylinder comprising an elongated bar of substantially channel shaped configuration which includes a pair of side wall portions with upper edges that are joined by a central wall portion and wherein at least a first of said side wall portions forms an obtuse angle with said central wall portion, said side wall portions having spaced apart parallel linear lower edges for abutment against a top region of a printing press cylinder while the bar extends in parallel relationship therewith, said first side wall portion of said bar having a row of spaced apart register pin receiving openings extending therealong which register pin openings are equidistantly spaced from the lower edge of said first side wall portion.

14. A method of mounting flexographic printing plates on a cylindrical surface of a rotary printing press plate cylinder comprising the steps of:

resting a substantially channel shaped bar on said cylindrical surface of said printing press plate cylinder in an orientation at which parallel spaced apart first and second linear regions of the channel shaped bar are in abutment with said cylindrical surface, pinning a flexographic printing plate having spaced apart register pin openings to said bar at locations thereon which are equidistant from said first linear region and equidistant from said second linear region, adhering a first portion of said flexographic printing plate to said cylindrical surface, unpinning said flexographic printing plate from said bar and removing said bar from said cylindrical surface, and wrapping said flexographic printing plate around said cylindrical surface while adhering other portions of said plate thereto.

* * * * *